United States Patent [19]

Götting et al.

[11] 4,309,472

[45] Jan. 5, 1982

[54] SLATS SERVING AS PROTECTION AGAINST LIGHT

[75] Inventors: Joachim Götting, Kelkheim; Heiner Zimmermann, Trebur, both of Fed. Rep. of Germany

[73] Assignee: Hoechst Aktiengesellschaft, Frankfurt am Main, Fed. Rep. of Germany

[21] Appl. No.: 154,031

[22] Filed: May 28, 1980

[30] Foreign Application Priority Data

May 30, 1979 [DE] Fed. Rep. of Germany ... 7915593[U]

[51] Int. Cl.[3] ..... D03D 3/00

[52] U.S. Cl. ..... 428/224; 428/229; 428/232; 428/480; 428/920

[58] Field of Search ..... 428/224, 229, 230, 231, 428/920, 296, 480, 245

[56] References Cited

U.S. PATENT DOCUMENTS

| | | | |
|---|---|---|---|
| 2,032,605 | 3/1936 | Whitehead | 428/229 |
| 2,060,664 | 11/1936 | Cohn | 428/229 |
| 3,941,752 | 3/1976 | Kleiner et al. | 260/DIG. 24 |
| 4,144,371 | 3/1979 | Okie et al. | 428/245 |

*Primary Examiner*—James J. Bell

*Attorney, Agent, or Firm*—Curtis, Morris & Safford

[57] ABSTRACT

Slats made from linear synthetic polyester fibers, which serve as protection against light, characterized in that they consist of shrunk flat textile structures that have been stiffened permanently by plastification.

6 Claims, 1 Drawing Figure

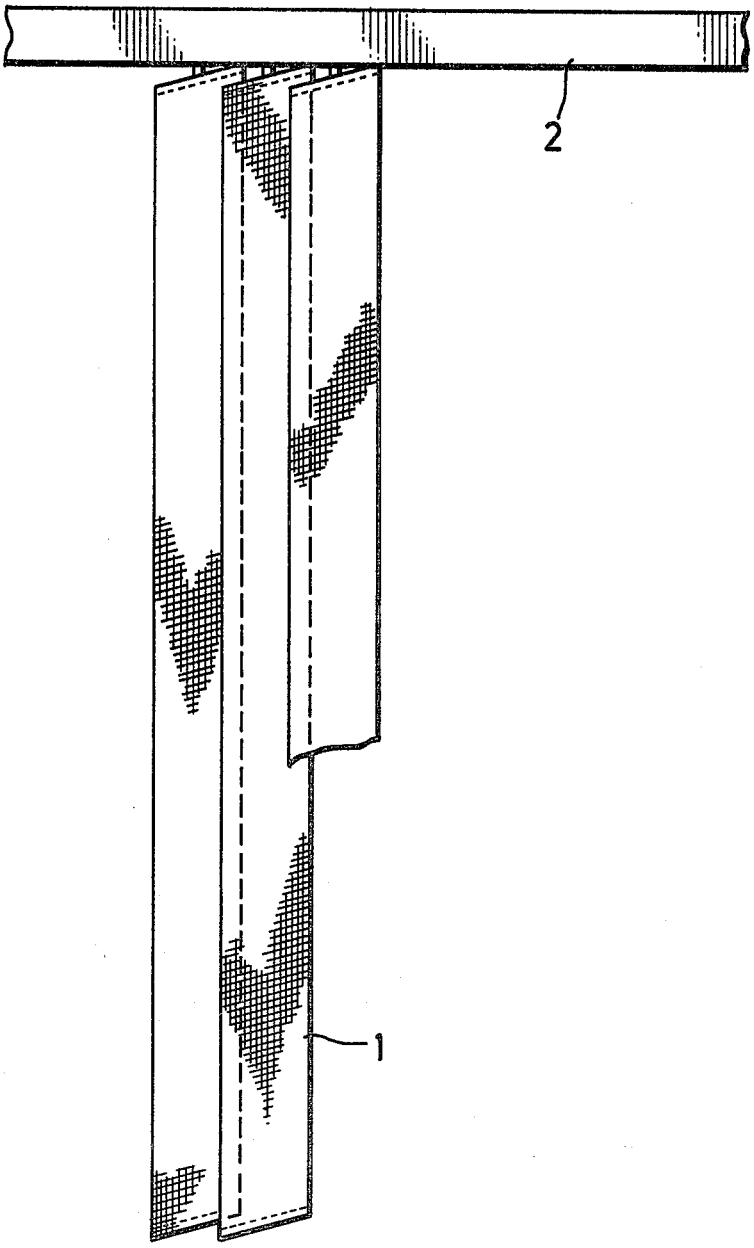
2
1

SLATS SERVING AS PROTECTION AGAINST LIGHT

The present invention relates to slats made from linear synthetic polyester fibers, which serve as protection against light. Slats of this type are mainly used in Venetian blinds, especially those having vertically arranged slats. They serve as protection against sun or sight at windows or glassy areas, as room dividers, as decorative elements and so on.

Most of the slats known nowadays are made from solid plastic material, from metal or wood. However slats made from textile materials are also known. For example, German utility model No. 71 17 085 discloses slats for use in Venetian blinds that serve as protection against sun or as room dividers. These slats consist of textile materials such as woven or knitted fabrics or of other flat textile structures made from synthetic yarns and fibers and into which monofilaments of polyamide or another high-molecular linear polyester are incorporated in a traverse direction.

Slats made from solid plastic, from metal or wood, especially Venetian blinds having vertically suspended slats, give a cold, unpleasant impression. Moreover, the impermeability to light of said materials is very often disadvantageous. Wood has the disadvantage of being readily flammable.

Before flat textile structures are processed to slats, they are finished or coated to confer the required stiffness. However, these steps involving expensive materials are complicated and result very often in a loss of the textile character of the material used. When finished goods are used they are likely to undergo stress-whitening, a color change and yellowing. Moreover, stiffening finishes often increase the flammability of the material in question. Textile materials may also be reinforced by rigid monofilaments, which requires, however, great expenditure on material and on work. A significant disadvantage of most textile materials is their flammability. Most known textile slats are not flame-proof as required for constructial materials according to German industrial standard DIN No. 4102 B 1.

It is an object of the present invention to provide slats which do not have these disadvantages, are pleasant to the eye, are flame-proof and are easy to prepare without the use of auxiliaries.

This object has been attained by the present invention, which relates to slats made from linear, synthetic polyester fibers serves as protection against light. The slats consist of shrunk flat textile structures permanently stiffened by plastification. The term fibers includes not only staple fibers but also continuous filaments and monofilaments.

In a preferred embodiment of the slats according to the invention the fibers contain copolyesters. In a further preferred embodiment according to the invention, flame retarding agents have been incorporated into the fibers. The fibers suitable for the manufacture of the novel slats consist of polyesters, for example polyethylene terephthalate, polybutylene terephthalate or copolyesters thereof in conjunction with components as usual in the manufacture of fibers for example isophthalic acid, trimethylene glycol and so on and optionally a flame retarding agent incorporated into the raw material of the fiber. Suitable flame retarding agents are phosphorus or phosphorus compounds.

The slats may moreover contain other known organic or inorganic components, such as halogen or antimony, that are mixed with the raw material for the fiber prior to spinning. A particularly preferred embodiment of the slats according to the invention comprises polyester fibers as prepared according to German Auslegesschrift No. 2,346,787 (U.S. Pat. No. 3,941,752).

The quantity of flame retarding agent contained in the raw material for the fiber varies from 0.1 to 20 weight %, preferably 2.5 to 12 weight %, referred to the weight of the fibers or of the slats, respectively.

A preferred flame-proofing agent consists of chain members having structural units of the formula

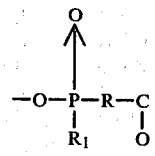

in which R is saturated, open-chain or cyclic alkylene, arylene or aralkylene and $R_1$ is alkyl with up to 6 carbon atoms, aryl or aralkyl, that have been incorporated into the polyester chains by condensation.

The raw material may further contain coloring pigments, dulling agents, antistatics, stabilizers and other substances capable of imparting upon the fibers the desired properties.

If the requirement as to the flame-proofness of the slats serving as protection against light are not very high, the fibers need not necessarily contain a flame retarding agents or there may be used mixtures of fibers without flame retarding agents and of fibers containing such agents.

Suitable flat textile structures for preparing the slats according to the invention are woven fabrics, knitted fabrics and non-wovens as prepared according to processes common for fiber materials. Staple fibers are processed directly to flat non-wovens.

Filaments may be processed directly to woven fabrics, knitted fabrics or fleeces, optionally to spunbonds. Alternatively the fiber materials may be used as blends or they may contain effect yarns or differently colored yarns or fibers. Any desired shape and structure of the flat textile articles is suitable and any taste may be satisfied. The flat structures have a weight per surface area of from about 50 to 500 g/m$^2$, preferably from 120 to 300 g/m$^2$.

To render the flat articles stiff, they are exposed to plastification in thermofixation means, for example a flat tenter frame, a fixation apparatus with perforated drum or a calender, for 10 seconds to 10 minutes, preferably for 30 to 40 seconds, in tensionless state or in a state appropriate to permit a certain shrinkage. Flat articles containing polyethylene terephthalate fibers are treated at a temperature from 220° to 255° C., preferably from 230° to 250° C. and polybutylene terephthalate fibers are treated at a temperature by about 25° to 30° C. lower. In the case of fibers consisting of copolyesters, the temperature may be reduced by about at least 5° to 20° C. The temperature and the duration of the heat treatment depend greatly on the desired degree of stiffness of the slats.

The flat articles submitted to the heat treatment are cut into slats.

The flat articles or the slats may alternatively be colored. Dyeing may be carried out prior to or after the heat treatment. Coloring by printing, for example by thermotransfer printing is suitably carried out after the heat treatment.

A BRIEF DESCRIPTION OF THE DRAWING

The drawing represents a schematic view of slats according to the present invention.

In the FIGURE, the slat (1) is suspended from a support (2) so as to protect against light, for example, as a blind or as a room divider.

The present invention will be illustrated in the following examples:

EXAMPLE 1

A raw material based on polyethylene terephthalate, which has been prepared according to the procedure of Example 1 of German Auslegeschrift No. 2,346,787 and which has been modified by 2-carboxyethylmethylphosphinic acid is used to prepare filaments of a titer of 3.3 dtex/60 mm, which are subsequently processed to yield a single yarn of 250 dtex fineness. A decorative fabric having a twill weave 2/2 and a weight per surface area of 160 g/m$^2$ is manufactured from the single yarn obtained. This decorative fabric is exposed to a heat treatment for 30 seconds in a tenter frame at a temperature of 240° C., in tensionless state to permit a certain shrinkage. The resulting material is elastic and stiff and can be printed without impairing its stiffness. The material is cut to yield slats of excellent quality which fulfill the requirements of German industrial standard DIN 420 B 1 as regards the flame-proofness.

EXAMPLE 2

A decorative fabric having a modified basket weave and a weight per surface area of 220 g/m$^2$ is prepared from the same yarn as in Example 1 and exposed to a heat treatment for 40 seconds at 230° C. in a tenter frame in tensionless state to permit a certain shrinkage. The goods are printed and cut to yield slats having a good stiffness and a good aspect, which fulfill the requirements of German industrial standard DIN No. 4102 B 1 as regards the flame-proofness.

The slats protecting against light in accordance with the present invention have excellent utilitarian properties, for example high resistance to light, a low tendency to yellowing and, consequently, a long life.

What is claimed is:

1. Slat means for protecting against light comprising a textile slat made from linear synthetic polyester fibers, said slat being stiffened permanently by heat shrinkage and containing a flame-retarding agent which consists of said polyester containing chain members having structural units of the formula

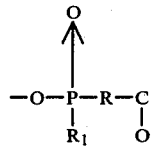

in which R is saturated, open-chain or cyclic alkylene, arylene or aralkylene and $R_1$ is alkyl with up to 6 carbon atoms, aryl or aralkyl, that have been incorporated into the polyester chains by condensation.

2. The slat means as claimed in claim 1, characterized in that the fibers consist of copolyesters.

3. The slat means claimed in claim 1 wherein the fibers are polyethylene terephthalate, polybutylene terephthalate or copolyesters thereof.

4. The slat means as claimed in claim 1 wherein the fibers contain isophthalic acid or trimethylene glycol.

5. The slat means as claimed in claim 1, 3 or 4 wherein the flame retarding agent is contained in an amount of from 0.1 to 20 weight %, based on the weight of the slat.

6. The slat means as claimed in claim 5 wherein the flame retarding agent is contained in an amount of from 2.5 to 12 weight %, based on the weight of the slat.

* * * * *